United States Patent [19]

Huber

[11] Patent Number: 4,854,085

[45] Date of Patent: Aug. 8, 1989

[54] RANDOM ORBITAL SANDER

[75] Inventor: Paul W. Huber, Lancaster, N.Y.

[73] Assignee: Dynabrade, Inc., Tonawanda, N.Y.

[21] Appl. No.: 100,588

[22] Filed: Sep. 24, 1987

[51] Int. Cl.[4] ..... B24B 23/00

[52] U.S. Cl. ..... 51/170 MT

[58] Field of Search ..... 51/170 MT; 384/482, 384/140; 277/95

[56] References Cited

U.S. PATENT DOCUMENTS

| | | | |
|---|---|---|---|
| 2,794,303 | 6/1957 | Wickes | 51/170 MT |
| 3,010,771 | 11/1961 | Cogger | 384/482 |
| 3,747,280 | 7/1973 | Stroezel et al. | 51/170 MT |
| 4,102,084 | 7/1978 | Bloomquist | 51/170 MT |

OTHER PUBLICATIONS

Marks' Standard Handbook for Mechanical Engineers, 8th Ed. Chapter 8, p. 141, copyright 1978.

*Primary Examiner*—Frederick R. Schmidt
*Assistant Examiner*—Maurina Rachuba
*Attorney, Agent, or Firm*—Bean, Kauffman & Spencer

[57] ABSTRACT

An assembly for connecting a sanding pad or the like to a driver having an axis of rotation, wherein the sanding pad is adapted to undergo free rotational movement about a second axis disposed parallel to the axis of rotation, as such sanding pad is caused to orbit about such axis of rotation. The assembly features a bearing assembly for supporting the sanding pad for rotation about the second axis, wherein an improved seal is provided to prevent ingress of abrasive materials into the bearing assembly during operation of the sanding pad, so as to prolong the useful life of the bearing assembly.

5 Claims, 1 Drawing Sheet

Fig. 1.
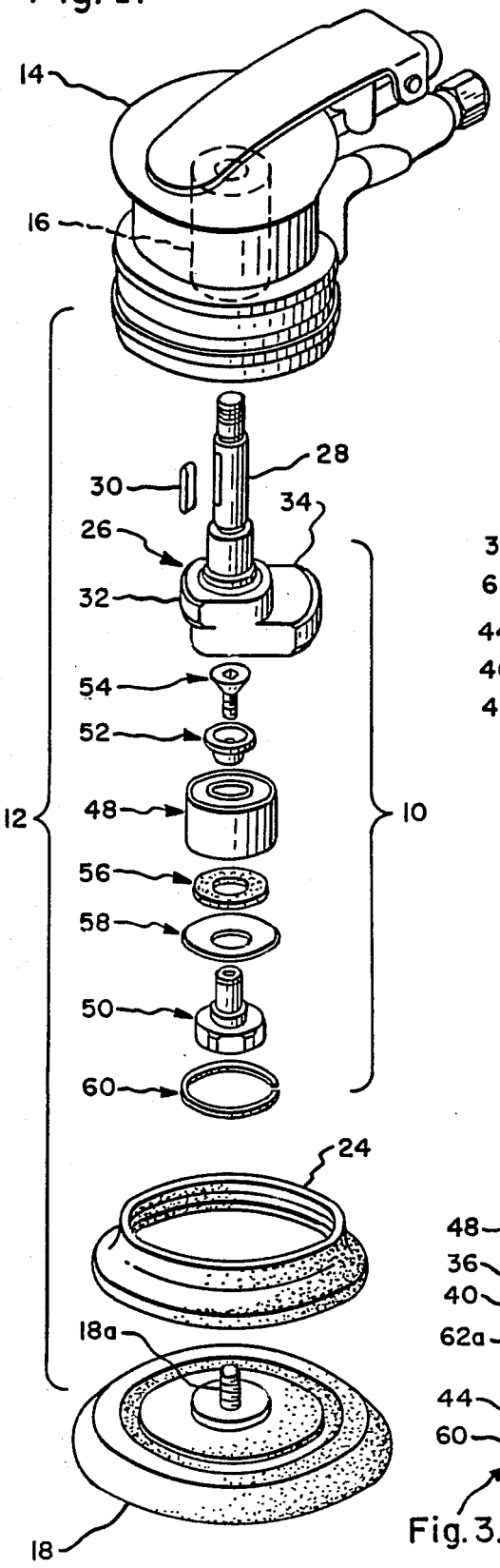
Fig. 4.
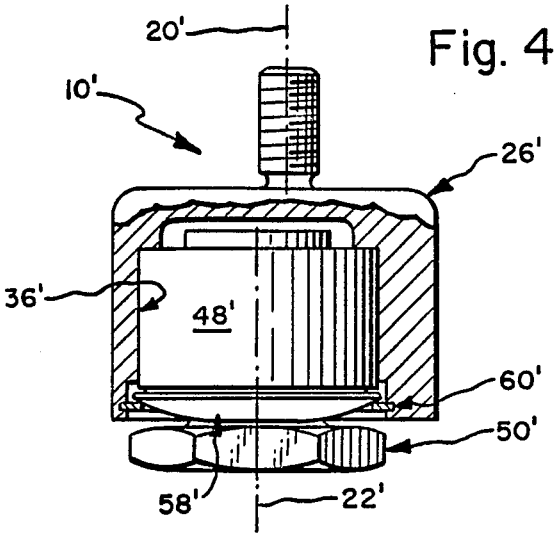
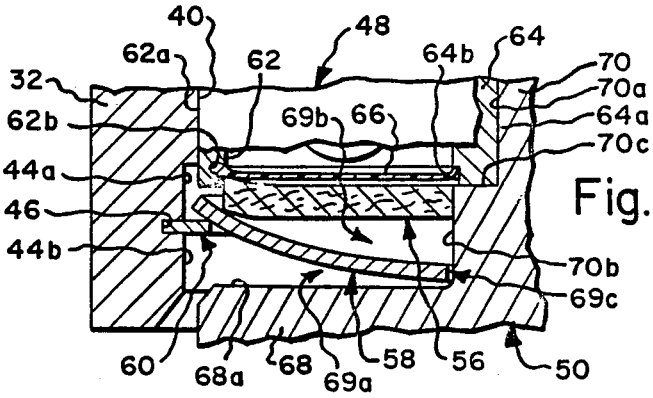
Fig. 3.
Fig. 2.
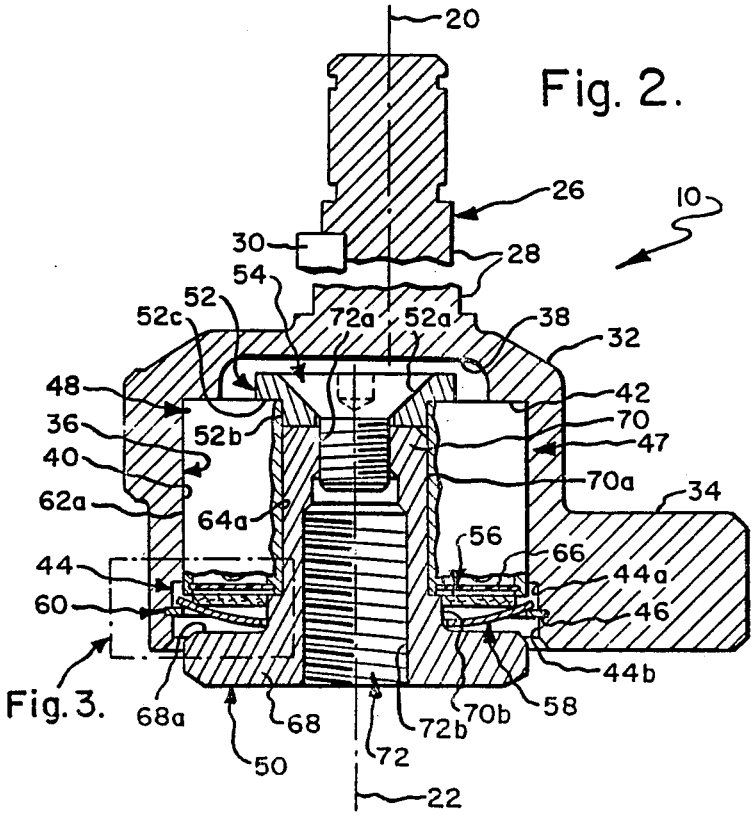
Fig. 3.

RANDOM ORBITAL SANDER

BACKGROUND OF THE INVENTION

Random orbital sanders are well known and generally comprise a motor for driving a balanced shaft for rotational movement about a first or driven axis, and a bearing device for coupling a sanding pad or disc to the balanced shaft for rotational movement relative thereto about a second axis disposed in an offset or parallel relation to the first axis. During operation of this type of sander, the sanding pad is forced to move along a circular path disposed concentrically of or to orbit relative to the first axis, while being free to rotate relative to the second axis.

Prior random orbital sanders suffer from a common practical drawback, namely, the relatively short useful life span of the bearing devices employed to rotationally couple their balanced shafts and sanding pads as a result of ingestion of abrasive materials to which they are exposed during use.

SUMMARY OF THE INVENTION

The present invention relates to an assembly particularly adapted for use in connection with a random orbital sander, and more particularly to an improved sealing arrangement for minimizing the ingress of abrasive materials into the bearing thereof such as would otherwise tend to shorten its useful life.

A preferred form of the assembly of the present invention includes a balanced shaft adapted to be driven for rotation about a first axis and having a mounting recess defining a second axis disposed parallel to the first axis, and a bearing assembly fitted within the mounting recess for purposes of supporting a sanding pad or the like for free rotational movement relative to the balanced shaft about the second axis, as the sanding pad moves along a circular path of travel about the first axis. The bearing assembly includes a ball bearing device having an outer race fixed to the balanced shaft within the mounting recess and an inner race; a balancer shaft for attaching the sanding pad for rotation with the inner race; a bearing shield in the form of a Belleville washer carried by the balanced shaft within the mounting recess and cooperating with the balancer shaft to define an entrance portion of a seal passage leading to the bearing device, which converges in a direction extending radially inwardly towards the second axis; and a bearing seal in the form of a washer having a radially inner edge arranged in an interference sliding fet with the balancer shaft and a radially outer edge clamped between the Belleville washer and the outer race.

BRIEF DESCRIPTION OF THE DRAWINGS

The nature and mode of operation of the present invention will now be more fully described in the following detailed description taken with the accompanying drawings wherein:

FIG. 1 is a partially exploded perspective view of a random orbital sander incorporating the assembly of the present invention;

FIG. 2 is a vertical sectional view taken through the assembly;

FIG. 3 is an enlarged view of the area designated as FIG. 3 in FIG. 2; and

FIG. 4 is a partial sectional view similar to FIG. 2, but showing an alternative form of the present invention adapted for removable attachment to a separate power source.

DETAILED DESCRIPTION

Reference is first made to FIG. 1, wherein an assembly formed in accordance with the present invention is generally designated as 10 and shown as being formed as an integral component of manually operated, otherwise conventional random orbital sander 12 having a housing 14 containing an air or other suitably powered motor, shown generally as 16. Assembly 10 serves to interconnect an externally mounted sanding pad 18 to motor 16 such that the sanding pad is caused to orbit about a first or drive axis 20 of the motor, while being free to rotate about a second axis 22, which is defined by assembly 10 and disposed parallel to the first axis. A suitable shroud 24 may be mounted on housing 14 for cooperation with the upper or rear surface of sanding pad 18 or the work being sanded, not shown, as may be desired.

Assembly 10 includes a balanced shaft 26, which is of conventional construction from the standpoint that it includes a driven shaft portion 28 adapted to be supported within the confines of housing 14 and coupled to motor 16 by a key 30 for rotational movement about first axis 20 and an enlarged head portion 32, which defines a counterbalancing weight 34 and a stepped diameter mounting recess 36 whose axis is disposed coincident with second axis 22. Mounting recess 36 is shown in FIG. 2 as including a relatively small diameter, inner end or clearance portion 38; an intermediate diameter, mounting portion 40, which cooperates with the inner end portion to define an annular stop surface or abutment 42; and a relatively large diameter outer end portion 44, which is divided into relatively inner and outer parts **44*a* and 44*b*, respectively, by an annular mounting groove 46**.

Assembly 10 is shown in FIG. 1 as additionally including a bearing assembly 47 defined by a ball bearing device 48, a balancer shaft 50, a bearing washer 52, an assembly screw 54, a bearing seal 56, a bearing shield 58 and a C-shaped snap ring retainer 60. As best shown in FIG. 3, bearing device 48 includes an outer race 62 having an outer surface **62*a* sized for slidable receipt within mounting portion 40 in end engagement with stop surface 42 and an inner race 64 having an inner surface 64*a* disposed concentrically of outer surface 62*a*. Preferably, each end of the space between outer and inner races 62 and 64 is closed off or sealed by plastic end or closure ring 66 shown as being removably resiliently snap fitted within undercut recess 62*b* provided adjacent each end of the outer race and arranged to slidably bear on a seal surface defined by annular groove 64*b* provided adjacent each end of the inner race. With this construction, each end ring 66 tends to remain stationary relative to and positively seal against outer race 62, while such end ring tends to provide a sliding seal with inner race 64**.

Balancer shaft 50 serves as a means for connecting sanding pad 18 to inner race 64 for rotation therewith includes an enlarged head or outer end portion 68 and a shank or inner end portion 70 whose outer surface is stepped to define a reduced diameter free end portion **70*a* sized to be slidably received by inner surface 64*a* of bearing device inner race 64 and an enlarged diameter outer end portion 70*b*, which cooperates with end portion 70*a* to define an annular stop surface or abutment 70*c*. Balancer shaft 50 is also formed with an axially extending stepped, threaded mounting opening 72 having a reduced diameter inner end 72***a* sized to threadably receive assembly screw 54 and an enlarged diameter outer end 72*b* sized to threadably receive a mounting screw 18*a* forming a part of sanding pad 18.

Bearing washer 52 is formed with a centrally located through opening 52*a* sized to freely receive assembly screw 54 and a stepped diameter outer surface including a reduced diameter end portion 52*b* sized to be slidably received by inner surface 64*a* of bearing device inner race 64 and a radially extending stop surface or abutment 52*c*.

Bearing seal 56 is in the form of a washer, which is preferably formed of felt or other suitable, somewhat flexible and soft non-abrasive material. Bearing seal 56 is internally sized and positioned such that it forms a close or interference fit with shaft outer end portion 70*b* adjacent annular stop surface 70*c*, as best shown in FIG. 3. Bearing seal 56 is also shown as being externally sized to extend essentially coextensive with its adjacently disposed end ring 66.

Bearing shield 58 is shown as being in the form of a Belleville washer or spring sized to permit the bearing shield to be slidably fitted within mounting recess outer end portion 44 such that its inner edge is disposed closely adjacent, but free of contact with, the balancer shaft 50 adjacent the juncture of inwardly facing surface 68*a* of head portion 68 and end portion 70*b*. Bearing shield 58 is removably retained in mounted position by snap ring retainer 60.

The Belleville washer employed in forming bearing shield 58 does not perform a spring function and could be formed of any suitable disc shaped, relatively rigid material, such as a common metal or plastic washer. However, it is preferable to employ a Belleville washer in forming bearing shield 58, due to its natural frustoconical configuration, which allows the overall length of the bearing assembly and thus mounting opening 36 to be reduced in size as compared to that which would be required if a flat washer were to be employed. Further, a Belleville washer is preferred in that its convex or outer surface cooperates with inwardly facing surface 68*a* of head portion 68 to define an entrance 69*a* for a seal passageway, which converges in a direction towards axis 22, and its concave or inner surface cooperates with bearing seal 56 to define an adjacent or inner portion 69*b* of such passageway, which converges in a direction away from axis 22. The convergent entrance, 69*a* coupled with the rotational movement of inwardly facing surface 68*a* relative to bearing shield 58, is quite effective in retarding radially inwardly directed movement of abrasive particles of all sizes towards the constricted seal passage 69*c* defined by the inner edge of the bearing shield and the juncture of surfaces 68*a* and 70*b*, which determines the maximum size of particle which can gain entrance to the adjacent portion 69*b* of the seal passageway defined by the bearing shield and bearing seal 56.

The bearing assembly may be assembled by placing in succession snap ring retainer 60, bearing shield 58 and bearing seal 56 about balancer shaft end portion 70*b*. Balancer shaft end portion 70*a* and bearing washer reduced diameter end portion 52*b* are then slid into opposite ends of inner race 64, and assembly screw 54 inserted and tightened for purposes of clamping stop surfaces 70*c* and 52*c* against such opposite ends of the inner race. A small amount of a suitable anaerobic adhesive is then applied to surface 62*a* of outer race 62 and bearing device 48 inserted into intermediate portion 40 of mounting recess 36 until the inner or inserted end of the outer race is placed in abutting engagement with stop surface 42 to define the assembled position of the bearing device relative to balanced shaft 26. After curing of the adhesive, retainer 60 is snapped into mounting groove 46; the retainer thereupon serving to lift bearing shield 58 from engagement with surface 64*a* of balancer shaft head portion 68 and force the concave surface of the bearing shield into engagement with bearing seal 56 for purposes of clamping the latter intermediate the bearing shield and end ring 66 and/or the end of outer race 62, depending on the chosen external diameter of the bearing seal. Clamping of bearing seal 56 in this manner serves both to rotatably fix the bearing seal relative to outer race 62, and thus balanced shaft 26, and to axially fix the bearing shield 58 relative to the juncture of balancer shaft surfaces 68*a* and 70, so as to define the maximum size particle capable of entering the seal passageway beyond the inner peripheral edge surface of the bearing shield. The degree to which bearing seal 56 is deformed by bearing shield 58 is a matter of choice and will depend upon the material from which the bearing seal is formed; the primary consideration being that the bearing shield is accurately located relative to balancer shaft 50 when the bearing assembly is in a fully assembled condition.

During operation of assembly 10, driven rotations of balanced shaft 26 effects orbital movement of the bearing assembly and thus sanding pad 18 about first axis 20, and frictional engagement of the orbiting sanding pad with a workpiece effects rotation of the sanding pad and thus balancer shaft 50 to which same is affixed relative to the balanced shaft about axis 22. As balancer shaft 50 rotates relative to balanced shaft 26 about axis 22, bearing seal 56 and bearing shield 58 are maintained in a rotationally fixed relationship relative to the balanced shaft; the bearing seal forming a rotary dust seal and the bearing shield forming a constricted seal passageway opening relative to the balancer shaft. While it is possible for particles and dust to enter recess outer end portion 44*a* past retainer 60, due to its split ring construction, any such particles and dust are simply captured therewithin and effectively prevented from moving towards the interior of bearing device 48, due to the seal provided by clamping the outer peripheral portion of bearing seal 56 between bearing shield 58 and end ring 66 and/or outer race 62. The interference fit between the inner peripheral portion of bearing seal 56 and shaft portion 70*b* creates a very effective dust seal in that deformation of the bearing seal creates a bias tending to maintain the bearing seal in snug sealing contact with the shaft.

As previously mentioned, the convergent nature of the passageway defined by the relatively rotating inner surface 68*a* of head portion 68 and bearing shield 58 is quite effective in preventing radially inwardly directed movement of particles and dust towards the passageway constriction defined by the close proximity of the inner peripheral portion or edge of the bearing seal and the juncture of surfaces 68*a* and 70*b*. Any dust particles passing beyond this constriction are captured or collected within the relatively large void defined by the inner surface of bearing shield 58 and the outer surface of bearing seal 56 and thereafter prevented from migrating towards bearing device 48 by the seals established by the bearing seal adjacent its inner and outer peripheral edge portions.

FIG. 2 shows a modified form of the assembly of the present invention, which is designated as 10′ and adapted for attachment via a balanced shaft 26′ to a separate source of power, such as a pneumatically or electrically powered, hand operated drill, not shown. Aside from the external appearance of balanced shaft 26′, assembly 10′ is identical to previously described assembly 10, and accordingly primed numerals are employed in FIG. 2 to designate like parts of these assemblies.

What is claimed is:

1. An assembly for connecting a sanding pad or the like to drive means having an axis of rotation, whereby to support said sanding pad for free rotational movement about a second axis disposed parallel to said axis of rotation as said second axis is caused to orbit about said axis of rotation, said assembly including in combination:

a balanced shaft having means for attachment to said drive means for rotation about said axis of rotation and a mounting recess having an axis disposed coincident with said second axis;

a bearing device formed with an outer race fixed within said mounting recess and an inner race rotatably supported by said outer race for relative rotational movement about said second axis;

a connection means for attaching said sanding pad to said inner race for rotation therewith, said connecting means including a shaft portion connected to said inner race and having an outer surface and an enlarged head portion having a surface extending radially outwardly from adjacent a juncture thereof with said outer surface and arranged to face towards said bearing device;

a bearing shield carried by said balanced shaft adjacent an outer end of said mounting recess, said bearing shield having a radially inner edge disposed in close proximity to said juncture to form a constricted passageway between said bearing shield and said connecting means, said bearing shield cooperates with said surface of said head portion to define an entrance leading to said constricted passageway, and said entrance converges radially inwardly towards said second axis; and a bearing seal arranged within said mounting recess axially intermediate said bearing device and said bearing shield to project generally radially of said second axis, and said bearing seal having radially inner and outer edge portions supported by said outer surface of said connecting means and said bearing shield, respectively.

2. An assembly according to claim 1, wherein said bearing seal is formed of a relatively soft, non-abrasive material, has said radially inner edge portion thereof disposed in a sliding interference fit with said outer surface of said shaft portion and has said radially outer edge portion thereof clamped between said bearing shield and said outer race.

3. An assembly for connecting a sanding pad or the like to drive means having an axis of rotation, whereby to support said sanding pad for free rotational movement about a second axis disposed parallel to said axis of rotation as said second axis is caused to orbit about said axis of rotation, said assembly including in combination:

a balanced shaft having means for attachment to said drive means for rotation about said axis of rotation and a mounting recess having an axis disposed coincident with said second axis, said mounting recess is of stepped diameter including an outer end portion formed with a retaining recess and an adjacent portion of relatively smaller diameter;

a bearing device formed with an outer race and an inner race rotatably supported by said outer race for relative rotational movement about said second axis, said outer race of said bearing device is fixed to said balanced shaft within said adjacent portion of said mounting recess to position an outer end portion of said bearing device to freely project into said outer end portion of said mounting recess;

a connecting means for attaching said sanding pad to said inner race for rotation therewith, said connecting means includes a balancer shaft having a shaft portion formed with an outer surface stepped to define an annular abutment and an enlarged head portion spaced from said abutment and means for attaching said shaft portion to said inner race to position said abutment in clamping engagement therewith, said enlarged head portion being disposed adjacent said outer end portion of said mounting recess and having a surface extending radially from said outer surface and facing towards said bearing device;

a bearing shield carried by said balanced shaft within said outer end portion of said mounting recess by retaining means received within said retaining recess, said bearing shield having a radially inner edge disposed in close proximity to the juncture of said outer surface of said shaft portion and said surface of said head portion to define a constricted passageway therebetween, said bearing shield cooperating with said surface of said head portion to define an entrance to said constricted passageway converging radially inwardly towards said second axis; and a bearing seal arranged within said outer end portion of said mounting recess axially intermediate said bearing device and said bearing shield to project generally radially of said second axis, and said bearing seal having radially inner and outer edge portions supported by said outer surface of said shaft portion and said bearing shield, respectively.

4. An assembly according to claim 3, wherein said bearing shield is a frusto-conically shaped washer having a concave surface thereof arranged to face towards said bearing seal and a convex surface arranged to face said surface of said head portion.

5. An assembly according to claim 4, wherein said bearing seal is a generally flat washer formed of a soft, non-abrasive material, said radially inner edge portion is disposed in interference sliding engagement with said outer surface of said shaft portion, and said radially outer edge portion is clamped by said concave surface of said bearing shield against said outer race.

* * * * *